US010711224B2

(12) United States Patent
Potocnik et al.

(10) Patent No.: US 10,711,224 B2
(45) Date of Patent: Jul. 14, 2020

(54) COMPOSITIONS AND METHODS USEFUL FOR REMOVING TABLET COATINGS

(71) Applicant: Ecolab USA Inc., St. Paul, MN (US)

(72) Inventors: Vesna Potocnik, Düsseldorf (DE); Thomas Altmann, Dormagen (DE)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 15/304,582

(22) PCT Filed: Apr. 16, 2014

(86) PCT No.: PCT/EP2014/057814
§ 371 (c)(1),
(2) Date: Oct. 17, 2016

(87) PCT Pub. No.: WO2015/158385
PCT Pub. Date: Oct. 22, 2015

(65) Prior Publication Data

US 2017/0037341 A1 Feb. 9, 2017

(51) Int. Cl.

| | |
|---|---|
| ***C11D 3/20*** | (2006.01) |
| ***C11D 7/26*** | (2006.01) |
| ***C11D 11/00*** | (2006.01) |
| ***B08B 3/08*** | (2006.01) |
| ***B08B 3/10*** | (2006.01) |
| ***C11D 1/66*** | (2006.01) |
| ***C11D 3/00*** | (2006.01) |
| ***C11D 3/33*** | (2006.01) |

(52) U.S. Cl.
CPC ..... *C11D 3/2086* (2013.01); *B08B 3/08* (2013.01); *B08B 3/10* (2013.01); *C11D 1/66* (2013.01); *C11D 3/0073* (2013.01); *C11D 3/2068* (2013.01); *C11D 3/2075* (2013.01); *C11D 3/33* (2013.01); *C11D 7/263* (2013.01); *C11D 11/0041* (2013.01)

(58) Field of Classification Search
CPC ..... C11D 3/2086; C11D 1/66; C11D 3/0073; C11D 3/2075; C11D 3/33; C11D 7/263; B08B 3/08; B08B 3/10
See application file for complete search history.

(56) References Cited

U.S. PATENT DOCUMENTS

| | | | | |
|---|---|---|---|---|
| 3,635,867 | A * | 1/1972 | Yuille | C08F 283/00 524/457 |
| 3,832,235 | A * | 8/1974 | Cooper et al. | C09D 9/005 134/11 |
| 3,832,305 | A * | 8/1974 | Murphy | C09D 9/00 252/175 |
| 4,537,705 | A * | 8/1985 | Mahoney | C09D 9/00 134/38 |
| 4,692,263 | A * | 9/1987 | Eberhardt | C09D 9/00 134/38 |
| 5,024,780 | A * | 6/1991 | Leys | C09D 9/04 134/38 |
| 5,106,525 | A * | 4/1992 | Sullivan | C09D 9/00 134/38 |
| 5,346,640 | A * | 9/1994 | Leys | C09D 9/005 134/38 |
| 5,609,693 | A | 3/1997 | Dobrez et al. | |
| 2003/0130147 | A1 | 7/2003 | Koito et al. | |
| 2006/0138399 | A1* | 6/2006 | Itano | C11D 7/08 257/40 |
| 2008/0210265 | A1* | 9/2008 | Crawford | C09D 9/04 134/38 |
| 2009/0042762 | A1 | 2/2009 | Zenfuku | |
| 2010/0180917 | A1 | 7/2010 | Tanaka et al. | |
| 2012/0264673 | A1 | 10/2012 | Keller et al. | |
| 2013/0065809 | A1* | 3/2013 | Savaglio | C09D 9/005 510/212 |

FOREIGN PATENT DOCUMENTS

| | | | |
|---|---|---|---|
| EP | 0 337 576 | A2 | 10/1989 |
| EP | 0 621 335 | A2 | 10/1994 |
| EP | 1 477 859 | A1 | 11/2004 |
| FR | 2 784 994 | A1 | 4/2000 |
| JP | 11-21482 | A | 1/1999 |
| JP | 2001-51429 | A | 2/2001 |
| JP | 2003-114540 | A | 4/2003 |
| JP | 2007-188077 | A | 7/2007 |
| JP | 2012-22178 | A | 2/2012 |
| JP | 2012-32757 | A | 2/2012 |
| JP | 2012-118368 | A | 6/2012 |
| WO | 98/06802 | A1 | 2/1998 |
| WO | 99/19448 | A1 | 4/1999 |
| WO | 2007/119392 | A1 | 10/2007 |
| WO | 2009/020199 | A1 | 2/2009 |

OTHER PUBLICATIONS

International Search Report for corresponding International Patent Application No. PCT/EP2014/057814 dated Jan. 5, 2015, 3 pgs.
Singapore Search Report for Application No. 11201608680W (Search Completed Sep. 25, 2017).
Singapore Written Opinion for Application No. 11201608680W (dated Oct. 9, 2017).

* cited by examiner

*Primary Examiner* — Sharidan Carrillo
(74) *Attorney, Agent, or Firm* — Merchant & Gould P.C.

(57) ABSTRACT

The present invention relates to a liquid cleaning composition can be a cleaning composition for removing an acrylic-based polymeric material useful as enteric tablet coatings located on a surface of a vessel or other process equipment comprising: —diethylen glycol mono butylether; and —water.

29 Claims, No Drawings

COMPOSITIONS AND METHODS USEFUL FOR REMOVING TABLET COATINGS

FIELD OF THE INVENTION

This application is a National Stage Application of PCT/EP2014/057814, filed 16 Apr. 2014, and which application is incorporated herein by reference. To the extent appropriate, a claim of priority is made to the above disclosed application.

The present invention relates to cleaning compositions and methods useful for removing acrylic based polymeric materials, such as acrylic-based polymeric tablet coatings, from vessels and other equipment employed in using such materials.

BACKGROUND OF THE INVENTION

An enteric tablet coating is a barrier applied to oral medication that controls the location in the digestive system where the active pharmaceutical components of the tablet are absorbed. Most enteric coatings work by presenting a surface that is stable at the highly acidic pH found in the stomach, but breaks down rapidly at a less acidic, relatively more basic pH in the small intestine. For example, they will not dissolve in the acidic juices of the stomach at about pH 3, but they will in the alkaline at about pH 7 to 9 environment present in the small intestine.

Drugs that have an irritant effect on the stomach, such as aspirin, can be coated with a substance that will dissolve only in the small intestine. Likewise, certain groups of azoles such as esomeprazole, omeprazole, and pantoprazole are acid-activated. For such types of drugs, enteric coating added to the formulation tends to avoid activation in the mouth and esophagus.

Recently, some companies have begun to utilize enteric coatings on fish oil capsules, such as omega-3 fatty acids supplements. The coating prevents the fish oil capsules from being digested in the stomach, which has been known to cause a fishy reflux or fish burps.

Sometimes the abbreviation "EC" is added beside the name of the drug to indicate that it has an enteric coating.

Over a period of time, the coating equipment and associated equipment, such as vessels, piping and the like, become heavily coated with such coating materials comprising polycarboxylic polymers such as acrylic-based polymers, fatty acids, waxes, shellac, plastics, and/or plant fibers. In particular, the coating material must be removed from the surfaces of the equipment in order that the equipment can perform its function effectively and efficiently. In addition, because the equipment is often used in the pharmaceutical and/or food industries, the cleaning operation itself must be effective to remove all of the coating material, and must be approved, for example, by the U.S. Food and Drug Administration, for use in the pharmaceutical and/or food industries. Such cleaning operations should also be cost effective.

Prior cleaning operations have involved manually scraping the acrylic-based polymer material from the process equipment.

U.S. Pat. No. 5,609,693 describes a method useful for removing an acrylic-based polymeric material located on a surface, for example, a surface of a piece of process equipment. The method includes contacting an acrylic-based polymeric material located on the surface of a piece of equipment with a composition containing at least about 20% by weight of water and an organic component containing at least one alkylene oxide group, preferably a plurality of alkylene oxide groups, per molecule in an amount effective to solubilize at least a portion of the acrylic-based polymeric material. One particularly useful solvent component described therein is triethylene glycol monoethyl ether sold by Olin under the trademark Poly-solve TE.

It is described in U.S. Pat. No. 5,609,693 that a process temperature for removing Eudragit L with a composition comprising triethylene glycol monoethyl ether requires a process temperature of about 90° C.

It is known that the acrylic polymeric based tablet coatings Eudragit L have about 10% hydrophilic groups compared to Eudragit RS 30D having about 5% by weight hydrophilic groups only. The drawback of the method described in U.S. Pat. No. 5,609,693 is that the process temperature of about 90° C. is high thus energy consuming and the cleaning performance with respect for removing residues of acrylic polymeric based tablet coatings being less hydrophilic is poor.

Other components such as 2-ethoxyethanol have a low flash point of about 44° C. A low flash point bears the danger of being flammable in a concentrated composition. Still yet other components such as ethylene glycol monobutyl ether has a flash point of about 67° C., a very strong pungent odor and is considered to be toxic. A strong pungent odor will be not accepted by the consumer.

One can see that there is a continuing need for providing an improved cleaning composition useful for removing acrylic based polymeric coating materials, such as acrylic-based polymeric tablet coatings, from vessels and other equipment employed in using such materials, that is effective at lower process temperatures, contains an active cleaning component having a high flash point above 70° C., is without a pungent smell, biodegradable and does not pose a risk to the health of the consumer.

SUMMARY OF THE INVENTION

The present invention is directed to a liquid cleaning composition for removing an acrylic-based polymeric material comprising:diethylene glycol monobutyl ether; and water.

According to one embodiment the liquid cleaning composition can be a cleaning composition for removing an acrylic-based polymeric material useful as enteric tablet coating located on a surface of a vessel or other process equipment, the composition comprising: diethylene glycol monobutyl ether; and water.

The acrylic-based polymeric material can be an enteric coating material located on a surface of a vessel or other process equipment.

Diethylene glycol monobutyl ether has a flash point above 70° C., is without a pungent smell, is biodegradable and does not pose a risk to the health of the consumer.

Surprisingly it has been found that an excellent cleaning performance may be achieved at about 23° C. to about 80° C. with a cleaning composition comprising diethylene glycol monobutyl ether as active cleaning component. Preferably the cleaning composition is employed at elevated temperatures in the range of about 50° C. to about 75° C., or preferably in the range of about 60° C. to about 75° C., and most preferred at about 75° C.

According to one embodiment the cleaning composition may comprise diethylene glycol monobutyl ether and is free of other glycol ethers, such as 1,2-propyleneglycol, dipropylene glycol, and butylene diglycol, In another embodiment the cleaning composition may comprise diethylene glycol monobutyl ether and be free of other glycol ethers and monoalcohols.

In another embodiment the cleaning composition may comprise diethylene glycol monobutyl ether and be free of other glycol ethers and silicates.

In another embodiment the cleaning composition may comprise diethylene glycol monobutyl ether and be free of silicates; mono-alcohols, such as ethanol, isopropanol, 2-butoxyethanol, 1-decanol, benzyl alcohol and the like; anionic surfactants; 1,2 propylene-glycol; dipropylene glycol; butylene diglycol; 1,3-butandiol; 1,4-butandiaol; and 2-butenoic acid.

It has been surprisingly found that the stability and the cleaning performance of the cleaning composition may be further improved by adding citric acid to the cleaning composition. For example a high concentration of diethylene glycol monobutyl ether may lead to a visible turbidity of the cleaning composition. The addition of citric acid gives and maintains a clear solution, which means a colorless solution of the concentrated cleaning composition as well as of the diluted composition.

In on embodiment the cleaning composition may comprise diethylene glycol monobutyl ether; at least one $C_2$ to $C_{10}$ organic acid; and water.

In another embodiment the cleaning composition may comprise diethylene glycol monobutyl ether; citric acid; and water, wherein the citric acid is anhydrous and added to adjust the pH of the cleaning composition.

The cleaning performance and the colorlessness of the cleaning composition can be improved, if the weight % ratio (wt.-%) of diethylene glycol monobutyl ether and at least one $C_2$ to $C_{10}$ organic acid, preferably citric acid, is adjusted to a defined amount.

According to one embodiment the cleaning composition may comprise of: diethylene glycol monobutyl ether and at least one $C_2$ to $C_{10}$ organic acid, preferably citric acid, wherein the wt.-% ratio of diethylene glycol monobutyl ether to $C_2$ to $C_{10}$ organic acid is from about 150:1 to about 30:1, preferably from about 100:1 to about 40:1, further preferred from about 95:1 to about 60:1, and more preferred from about 90:1 to about 70:1 and most preferred from about 85:1 to about 80:1, based on the total weight of the cleaning composition.

Other ingredients may be added to the cleaning composition. For example a surfactant can be added to improve the solvency, cleaning and emulsifying properties of the cleaning composition. Also a chelating agent may be added to soften the water. An emulsifying agent may be added to improve solubility of solvents and other raw materials. Further, a corrosion inhibitor may be added to increase the material compatibility.

In one embodiment the cleaning composition may comprise: diethylene glycol monobutyl ether, at least one $C_2$ to $C_{10}$ organic acid, preferably citric acid, at least one nonionic surfactant, preferably a $C_{12}$-$C_{14}$ fatty alcohol ethoxylate having 10 ethylene oxide ("EO") units, and most preferred a lauryl fatty alcohol ethoxybutyl ether having about 10 EO units, optionally a sequestering agent, preferably tetrasodium N,N-bis (carboxylatemethyl)-L-glutamate (GLDA), optionally a corrosion inhibitor, preferably methyl dihydrogen phosphate or methyl-1H-benzotriazole; and water.

DETAILED DESCRIPTION

Definition of Terms

So that the invention maybe more readily understood, certain terms are first defined.

As used herein, "acrylic-based materials as well as "acrylic-based coating materials" are polymers derived from one or more monomers selected from acrylic acid, acrylic acid esters, methyl acrylic acid, and/or methyl acrylic acid esters, preferably methyl acrylic acid and/or methyl acrylic acid esters; as well as mixtures thereof. The molecular weight of these polymers may vary over a broad range although it is preferred to use polymers having average molecular weights (g/mol) ranging between about 1,000 to about 10,000,000, preferably between about 5,000 up to about 1,000,000, further preferred between about 10,000 to about 500,000, also preferred between about 20,000 to about 250,000 and more preferred between about 25,000 to about 100,000 and most preferred between about 30,000 to about 50,000. A standard test method for determine the Molecular Weight Averages and Molecular Weight Distribution of these acryl-based polymers is by Liquid Exclusion Chromatography (Gel Permeation Chromatography—GPC)-ASTM D 3536-91, (1991).

As used herein, "weight percent", "wt.-%", "percent by weight", "% by weight", and variations thereof refer to a composition, component, substance or agent as the weight of that composition, component, substance or agent of the cleaning composition divided by the total weight of the cleaning composition or use composition multiplied by 100. It is understood that the total weight percent amount of all components, substances, or agents of the cleaning composition as well as use composition are selected such that it does not exceed 100 wt.-%.

It is understood that, as used here, "percent", "%", and the like are intended to be synonymous with "weight percent", "wt-%", etc.

As used herein, the term "about" refers to variation in the numerical quantity that can occur, for example, through typical measuring and liquid handling procedures used for making the cleaning composition in the real world; through inadvertent error in these procedures; through differences in the manufacture, source, or purity of the ingredients used to make the compositions or carry out the methods; and the like. The term "about" also encompasses amounts that differ due to different equilibrium conditions for a cleaning composition resulting from a particular initial mixture.

Whether or not, modified by the term "about", the claims include equivalents to the quantities.

It should be noted that, as used in this specification and the appended claims, the singular forms "a", "an", and "the" include plural referents unless the content clearly dictates otherwise.

It should also be noted that the term "or" is generally employed in its sense including "and/or" unless the content clearly dictates otherwise.

Active Cleaning Component for Removing Acrylic Based Polymeric Coating Material

In one embodiment the active cleaning composition comprises diethylene glycol monobutyl ether. Surprisingly it has been found that diethylene glycol monobutyl ether provides an excellent cleaning performance at lower temperatures from about 23° C. to about 80° C. In some embodiments the cleaning composition is preferably employed at elevated temperatures in a range from about 50° C. to about 75° C., or preferably in the range from about 60° C. to about 75° C., and most preferred at about 75° C.

Further, diethylene glycol monobutyl ether has a flash point above 70° C., does not possess a pungent smell, is biodegradable and does not pose a risk to the health of the consumer.

In another embodiment the cleaning composition is concentrated. The concentrated cleaning composition may comprise diethylene glycol monobutyl ether from about 50 wt.-% to about 90 wt.-%, preferably from about 60 wt.-% to about 85 wt-%, more preferred from about 65 wt.-% to about 80 wt.-% and most preferred from about 70 wt.-% to about 75 wt.-%, based on the total weight of the cleaning composition.

In another embodiment the cleaning composition is diluted or in a ready-to-use solution. The dilute cleaning composition may comprise diethylene glycol monobutyl ether from about 1 wt.-% to about 2 wt.-%, preferably from about 1.2 wt.-% to about 1.8 wt.-%, more preferred from about 1.3 wt.-% to about 1.6 wt.-% and most preferred from about 1.4 wt.-% to about 1.5 wt.-%, based on the total weight of the cleaning composition.

$C_2$ to $C_{10}$ Organic Acid

In one embodiments the cleaning composition comprises diethylene glycol monobutyl ether and a $C_2$ to $C_{10}$ organic acid, in a wt.-% ratio of about 150:1 to about 30:1, preferably from about 100:1 to about 40:1, further preferred from about 95:1 to about 60:1, and more preferred from about 90:1 to about 70:1 and most preferred from about 85:1 to about 80:1; based on the total weight of the cleaning composition. In some embodiments the preferred organic acid is citric acid.

Any of various $C_2$ to $C_{10}$ carboxylic acid components can be employed in accordance with the cleaning composition. Such components include the $C_2$ to $C_{10}$ carboxylic acids themselves, acid salts of such $C_2$ to $C_{10}$ carboxylic acids and mixtures thereof. Such $C_2$ to $C_{10}$ carboxylic acids include at least one carboxylic acid functionality, preferably two or more carboxylic acid functionalities. The $C_2$ to $C_{10}$ carboxylic acid component is preferably a polycarboxylic acid, having from about 1 to about 10 carbon atoms, preferably from about 3 to about 6 carbon atoms per molecule. It is important that if a salt of a $C_2$ to $C_{10}$ carboxylic acid is employed, that the pH of the concentrated cleaning composition may be adjusted to about a pH 4.5 to a pH 4.3 and for the diluted cleaning composition the pH may be adjusted to about a pH 4.5 to a pH 6.0, to facilitate removal of acrylic-based polymeric material in accordance with the cleaning composition.

Examples of carboxylic acid components useful in the present cleaning composition include $C_2$ to $C_{10}$ organic acids selected from the group comprising acetic acid, propionic acid, iso-propionic acid, butanoic acid, pentanoic acid, hexanoic acid, heptanoic acid, octanoic acid, nonanoic acid, decanoic acid, glycolic acid, citric acid, lactic acid, tartaric acid, fumaric acid, malic acid, itaconic acid, ascorbic acid, benzoic acid, salicylic acid, or succinic acid, and most preferred citric acid.

In one embodiment the cleaning composition is concentrated. The concentrated cleaning composition may comprise at least one $C_2$ to $C_8$ organic acid, preferably citric acid from about 0 wt.-% to about 5 wt.-%, preferably from about 0.5 wt.-% to about 3 wt.-%, further preferred from about 0.75 wt.-% to about 2.5 wt.-% more preferred from about 1 wt.-% to about 2 wt.-% and most preferred from about 1.6 wt.-% to about 1.8 wt.-% based on the total weight of the cleaning composition.

In another embodiment the cleaning composition is diluted or in a ready-to-use solution. The dilute cleaning composition may comprise from about 0 wt.-% to about 0.1 wt.-%, preferably from about 0.01 wt-% to about 0.06 wt.-%, further preferred from about 0.015 wt.-% to about 0.05 wt.-% more preferred from about 0.02 wt.-% to about 0.04 wt.-% and most preferred from about 0.03 wt.-% to about 0.04 wt.-% of at least one $C_2$ to $C_8$ organic acid, more preferred citric acid; based on the total weight of the cleaning composition.

Surfactant

The cleaning composition may include nonionic surfactants, cationic surfactants, amphoteric surfactants and mixtures thereof. The surfactant component can be used to reduce surface tension, as well as for improving the solvency, cleaning and emulsifying properties of the cleaning composition.

As used herein, "surfactant" refers to any agent that lowers the surface tension of a liquid, for example water. Exemplary surfactants which may be suitable for use with the present cleaning composition are described below. In one embodiment, surfactants may be selected from the group consisting of nonionic, cationic, amphoteric, zwitterionic, and combinations thereof. Most preferred, the cleaning composition is free of an anionic surfactant.

Nonionic Surfactant

Exemplary nonionic surfactants that can be used in the cleaning composition may be alkoxylated, preferably ethoxylated or ethoxylated and propoxylated, fatty acid alkyl esters preferably containing 1 to 4 carbon atoms in the alkyl chain, more preferred the fatty acid methyl esters.

Further surfactants include ethoxylated long chain fatty acid amides where the fatty acid has 8 to 20 carbon atoms and the amide group is ethoxylated with 1 to 20 ethylene oxide (EO) units.

A further class of nonionic surfactants the cleaning composition may contain, is the alkyl polyglycosides (APG). Suitable alkyl polyglycosides satisfy the general Formula RO(G)z where R is a linear or branched, particularly 2-methyl-branched, saturated or unsaturated aliphatic radical containing 4 to 22 carbon atoms and preferably 6 to 18 carbon atoms and where G stands for a glycoside unit containing 5 or 6 carbon atoms, preferably glucose. The degree of oligomerization, z, is a number from about 1.0 to about 4.0 and preferably from about 1.1 to about 1.4.

Additionally, non-ionic surfactants derived from the condensation of ethylene oxide with the product resulting from the reaction of propylene oxide and ethylene diamine are also useful. For example, there are compounds containing from about 40% to 80% of polyoxyethylene by weight and having a molecular weight from about 5,000 to about 11,000 resulting from the reaction of ethylene oxide groups with the reaction product of ethylene diamine and excess propylene oxide, wherein the reaction product of ethylene diamine and excess propyl oxide has a molecular weight on order of about 2,500-3,000 g/mol.

Suitable nonionic surfactants include: polyoxyethylene and polyoxypropylene condensates, which are sold by BASF under the trade name Pluronic®; polyoxyethylene condensates of aliphatic alcohols and ethylene oxide having from 1 to 30 moles of ethylene oxide per mole of coconut alcohol; ethoxylated long chain alcohols sold by Shell Chemical Co. under the trade name "Neodol™", polyoxyethylene condensates of sorbitan fatty acids; alkanolamides, such as the monoalkoanolamides, dialkanolamides; ethoxylated alkanolamides, coconut monoethanolamide, lauric isopropanolamide and lauric diethanolamide; and amine oxides dodecyldimethylamine oxide.

Other nonionic surfactants that can be used in the cleaning composition include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. These surfactants can have further blocks of either polyoxyethylene or polyoxypropylene in the molecules. A suitable average molecular weight range of useful surfactants can be from about 1,000 to about 40,000 g/mol and the weight percent content of ethylene oxide can be about 10-80 wt.-%.

A suitable polyethylene glycol for use in the cleaning composition can have an average molecular weight (g/mol) in the range from about 4000 to about 12000, preferably from about 6000 to about 10000 and more preferred from about 7000 to about 8000. Polyethylene glycol that can be used are marketed for example by BASF under the tradename PLURIOL®.

Accordingly, preferred embodiments of the cleaning composition comprises of at least one polyethylene glycol, preferably a polyethylene glycol with an average molecular weight in the range of 4.000 to 12.000 g/mol, and more preferred a polyethylene glycol having an average molecular weight of about 8,000 g/mol.

Further exemplary non-ionic surfactants include alkylphenol alkoxylates, and amine oxides such as alkyl dimethylamine oxide or bis(2-hydroxyethyl) alkylamine oxide.

Most preferred, the cleaning composition comprises of at least one nonionic surfactant, preferably at least one C4 to C18 alkyl polyglycoside or any combination thereof, preferably at least one C8 to C16 alkyl polyglycoside and more preferred a mixture of C8 to C16 alkyl polyglycosides.

More preferred is a nonionic surfactant, wherein the nonionic surfactant is selected from the group consisting of:

(i) C12-18 alkyl polyethylene glycol polypropylene glycol ethers having from about 1 to about 8 moles of ethylene oxide (EO) units and about 8 moles of propylene oxide units;
(ii) C12-18 alkyl polyethylene polybutylene glycol ethers having from about 1 to about 8 moles of EO units and about 8 moles of butylene oxide units;
(iii) end-capped alkyl polyalkylene glycol mixed ethers;
(iv) C8-14 alkyl polyglucosides with a degree of polymerization from about 1 to about 4;
(v) C12-14 alkyl polyethylene glycols having from about 3 to about 8 EO units,
(vi) glucamides;
(vii) hydroxy mixed ethers;
(viii) fatty alcohol alkoxylates; and
(ix) more preferred are $C_8$-$C_{18}$ fatty alcohol alkoxylates $C_2$-$C_6$ alkylether having from about 3 to about 15 EO and/or propylene oxide units, preferably from about 5 to about 10 EO or propylene oxide units;
(x) $C_8$-$C_{18}$ fatty alcohol $C_2$-$C_{10}$ alkyl polyglycosides, and mixtures thereof, whereby lauryl fatty alcohol ethoxybutyl ether having about 10 EO units is most preferred.

The cleaning composition, preferably in form of a concentrate, may comprises at least one nonionic surfactant from about 0 wt.-% to about 5 wt.-%, preferably from about 0.35 wt.-% to about 3.5 wt.-%, more preferred from about 0.7 wt.-% to about 2.8 wt.-% and most preferred from about 1.4 wt.-% to about 2 wt.-%, preferably a $C_8$-$C_{18}$ fatty alcohol alkoxylates $C_2$-$C_6$ alkylether having 3 to 15 EO or propylene oxide units, preferably 5 to 10 EO or propylene oxide units, more preferred a $C_{12}$-$C_{14}$ fatty alcohol ethoxylate $C_4$-alkylether having 10 EO units and most preferred a lauryl fatty alcohol ethoxybutyl ether having about 10 EO units; based on the total weight of the cleaning composition.

A diluted cleaning composition may comprise at least one nonionic surfactant from about 0 wt.-% to about 0.1 wt.-%, preferably from about 0.007 wt.-% to about 0.07 wt.-%, more preferred from about 0.014 wt.-% to about 0.06 wt.-% and most preferred from about 0.028 wt.-% to about 0.04 wt.-%, preferably a $C_8$-$C_{18}$ fatty alcohol alkoxylates, $C_2$-$C_6$ alkylether having from about 3 to 15 EO or propylene oxide units, preferably from about 5 to 10 EO or propylene oxide units, more preferred a $C_{12}$-$C_{14}$ fatty alcohol ethoxylate $C_4$-alkylether having 10 EO units and most preferred a lauryl fatty alcohol ethoxybutyl ether having about 10 EO units; based on the total weight of the cleaning composition.

Cationic Surfactants

The cleaning composition can contain a cationic surfactant component. The cationic surfactant can be used to provide sanitizing properties, to reduce surface tension, for improving the solvency, cleaning and emulsifying properties of the cleaning composition.

Cationic surfactants that can be used in the cleaning composition include, but are not limited to: amines such as primary, secondary and tertiary monoamines with C1-8 alkyl or alkenyl chains, ethoxylated alkylamines, alkoxylates of ethylenediamine, imidazoles such as a 1-(2-hydroxyethyl)-2-imidazoline, 2-alkyl-1-(2-hydroxyethyl)-2-imidazoline, and the like; and poly-sulfonate ammonium salts, as for example, alkylpoly-sulfonate ammonium chloride surfactants such as n-alkyl(C12-C18)dimethylbenzyl ammonium chloride, n-tetradecyldi-methylbenzylammonium chloride monohydrate, and a naphthylene-substituted poly sulfonate ammonium chloride such as dimethyl-1-naphthylmethylammonium chloride. Suitable cationic surfactants include quaternary ammonium compounds having the formula of $RR'R''R'''N^+X^-$, where R, R', R" and R'" are each a $C_1$-$C_{24}$ alkyl, aryl or arylalkyl group that can optionally contain one or more P, O, S or N heteroatoms, and X is F, Cl, Br, I or an alkyl sulfate.

Additional preferred cationic surfactants include ethoxylated or propoxylated alkyl amines, diamines, or triamines.

Each of R, R', R" and R'"can independently include, individually or in combination, substituents including 6 to 24 carbon atoms, preferably 14 to 24 carbon atoms, and more preferably, 16 to 24 carbon atoms.

Each of R, R', R" and R'" can independently be linear, cyclic, branched, saturated, or unsaturated, and can include heteroatoms such as oxygen, phosphorous, sulfur, or nitrogen. Any two of R, R', R" and R'" can form a cyclic group. Any one of three of R, R', R" and R'" can independently be hydrogen. X is preferably a counter ion and preferably a non-fluoride counter ion. Exemplary counter ions include chloride, bromide, methoxysulfate, ethoxysulfate, sulfate, and phosphate.

In another embodiment, the quaternary ammonium compound includes alkyl ethoxylated and/or propoxylated quaternary ammonium salts (or amines).

Preferably, the alkyl group contains from about 6 to about 22 carbon atoms and can be saturated or unsaturated. The degree of ethoxylation is preferably from about 2 to about 20, or the degree of propoxylation is preferably from about 0 to about 30.

In one embodiment, the quaternary ammonium compound includes an alkyl group with about 6 to about 22 carbon atoms and a degree of ethoxylation from about 2 to about 20. A preferred cationic surfactant is commercially available under the name Berol 563™ from Akzo-Nobel.

In some embodiments the cleaning composition may comprise at least one cationic surfactant, preferably in form of a concentrate, from about 0 wt.-% to about 5 wt.-%, preferably from about 0.35 wt.-% to about 3.5 wt.-%, more preferred from about 0.7 wt.-% to about 2.8 wt.-% and most preferred from about 1.4 wt.-% to about 2 wt.-%; based on the total weight of the cleaning composition.

An embodiment of a diluted cleaning composition may comprise at least one cationic surfactant from about 0 wt.-% to about 0.1 wt.-%, preferably from about 0.007 wt.-% to about 0.07 wt.-%, more preferred from about 0.014 wt.-% to about 0.06 wt.-% and most preferred from about 0.028 wt.-% to about 0.04 wt.-%; based on the total weight of the cleaning composition.

It should be understood that the cleaning composition can be preferably free of a cationic surfactant.

Amphoteric Surfactants

Amphoteric surfactants can also be used to reduce surface tension, for improving the solvency, cleaning and emulsifying properties of the cleaning composition. Suitable amphoteric surfactants that can be used include, but are not limited to: betaines, imidazolines, and propionates. Suitable amphoteric surfactants include, but are not limited to: sultaines, amphopropionates, amphodipropionates, aminopropionates, aminodipropionates, amphoacetates, amphodiacetates, and amphohydroxypropylsulfonates. When the concentrated cleaning composition includes at least one amphoteric surfactant, the amphoteric surfactant can be included in an amount from about 0 wt.-% to about 5 wt.-%, preferably from about 0.35 wt.-% to about 3.5 wt.-%, more preferred from about 0.7 wt.-% to about 2.8 wt.-% and most preferred from about 1.4 wt.-% to about 2 wt.-%; based on the total weight of the cleaning composition.

A diluted cleaning composition may comprise at least one amphoteric surfactant from about 0 wt.-% to about 0.1 wt.-%, preferably from about 0.007 wt.-% to about 0.07 wt.-%, more preferred from about 0.014 wt.-% to about 0.06 wt.-% and most preferred from about 0.028 wt.-% to about 0.04 wt.-%; based on the total weight of the cleaning composition.

It should be understood that the cleaning composition can be preferably free of an amphoteric surfactant.

Sequestering Agent

The cleaning composition may in addition comprise of at least one sequestering agent selected from the group of: sodium gluconate, pentasodium salt of diethylenetriamine pentaacetic acid (DTPA), sodium glucoheptonate, salts of ethylene diamine tetraacetic acid (EDTA), salts of ethylene diamine tetraacetic acid, salts of hydroxyethyl ethylene diamine triacetic acid, salts of hydroxyethyl ethylene diamine triacetic acid, salts of nitrilotriacetic acid, salts of nitrilotriacetic acid (NTA), diethanolglycine sodium salt, ethanol diglycine disodium salt, salts of hydroxymonocarboxylic acid compounds, salts of hydroxydicarboxylic acid compounds, salts of amine containing carboxylic acids, tetrasodium tetrasodium N,N-bis(carboxylatomethyl)-L-glutamate (GLDA), hydroxyethylethylene-diaminetriacetate (HEDTA), methylglycinediacetate (MGDA), and mixtures thereof, whereby tetrasodium tetrasodium N,N-bis(carboxylatomethyl)-L-glutamate (GLDA) is most preferred.

Another embodiment of, the cleaning composition, preferably in form of a concentrate, may comprise of at least one sequestering agent from about 0 wt.-% to about 5 wt.-%, preferably from about 0.05 wt.-% to about 1 wt.-%, more preferred from about 0.1 wt.-% to about 0.6 wt.-% and most preferred from about 0.2 wt.-% to about 0.5 wt.-%, more preferred tetrasodium tetrasodium N,N-bis(carboxylatomethyl)-L-glutamate (GLDA); based on the total weight of the cleaning composition.

Another embodiment of, the cleaning composition, preferably in form of a diluted composition, may comprise of at least one sequestering agent from about 0 wt.-% to about 0.1 wt.-%, preferably from about 0.001 wt.-% to about 0.02 wt.-%, more preferred from about 0.002 wt.-% to about 0.012 wt.-% and most preferred from about 0.004 wt.-% to about 0.01 wt.-%, more preferred tetrasodium tetrasodium N,N-bis(carboxylatomethyl)-L-glutamate (GLDA); based on the total weight of the cleaning composition.

It should be understood that the cleaning composition can be preferably free of a sequestering agent.

Corrosion Inhibitor

The cleaning composition may in addition comprise at least one corrosion inhibitor selected from the group comprising: silicate, sodium silicate, sodium disilicate, calcium acetate, calcium chloride, calcium gluconate, calcium phosphate, calcium borate, calcium carbonate, calcium citrate, calcium lactate, calcium sulfate, calcium tartrate, benzotriazole, 1,2,3-benzotriazole, or any combination thereof, more preferred at least one benzotriazole, even more preferred Polygon PCG 1419 and/or Polygon PCG 1831 and most preferred at least one methyl dihydrogen phosphate and/or methyl-1H-benzotriazole.

Polygon PCG 1419 is a corrosion inhibitor containing methyl dihydrogen phosphate and is available from Polygon Chemie AG. Polygon PCG 1831 is a corrosion inhibitor containing methyl-1H-benzotriazole and is available from Polygon Chemie AG.

Another embodiment of, the cleaning composition, preferably in form of a concentrate, may comprise of at least one corrosion inhibitor from about 0 wt.-% to about 3 wt.-%, preferably from about 0.1 wt.-% to about 2.5 wt.-%, more preferred from about 0.5 wt.-% to about 2 wt.-%, and most preferred from about 1 wt.-% to about 1.5 wt.-%, preferably benzotriazole, even more preferred Polygon PCG 1419 or Polygon PCG 1831 and most preferred at least one methyl dihydrogen phosphate or methyl-1H-benzotriazole; based on the total weight of the cleaning composition.

Another embodiment of, the cleaning composition, preferably in form of a diluted composition, may comprise of at least one corrosion inhibitor from about 0 wt.-% to about 0.06 wt.-%, preferably from about 0.002 wt.-% to about 0.05 wt.-%, more preferred from about 0.01 wt.-% to about 0.04 wt.-%, and most preferred from about 0.02 wt.-% to about 0.03 wt.-%, preferably benzotriazole, even more preferred Polygon PCG 1419 or Polygon PCG 1831 and most preferred at least one methyl dihydrogen phosphate or methyl-1H-benzotriazole; based on the total weight of the cleaning composition.

It should be understood that the cleaning composition can be preferably free of a corrosion inhibitor.

Solvent

In some embodiments, the cleaning composition further comprises as solvent water, whereby water is added to 100 wt.-%.

Additional Solvents

Other embodiments of the cleaning composition may further comprise additional solvents including, but are not limited to, mono-alcohols such as ethanol, isopropanol, 2-butoxy-ethanol, 1-decanol, benzyl alcohol, or combinations thereof.

The additional solvent may be added to 100 wt.-%.

It should be understood that the cleaning composition can be preferably free of a mono alcohol.

It should be understood that the cleaning composition can be preferably free of an additional solvent.

Concentrate

Some embodiments of the cleaning composition are in a liquid concentrated form. The concentrates include a liquid medium, preferably water, and relatively large concentrations of the active component or components. The concentrated liquid cleaning composition may have a pH in the range of about a pH 4.5 to about a pH 4.3 and for the diluted cleaning composition the pH may be adjusted to about a pH 4.5 to a pH 6.0. The concentrated liquid cleaning composition without a $C_2$ to $C_{10}$ organic acid, preferably free of citric acid, may have a pH range that is from about a pH 7.5 to about pH 11.

In some embodiments a solvent, preferably water, is added to 100 wt.-% of the cleaning composition, wherein the weight.-% of the components are based on the total weight of the cleaning composition, and the weight.-% of all components of the cleaning composition are select so that it does not exceed 100 wt.-%.

In other embodiments, the cleaning compositions, preferably in form of a concentrate, may comprise from about 50 wt.-% to about 90 wt.-%, preferably from about 60 wt.-% to about 85 wt.-%, more preferred from about 65 wt.-% to about 80 wt.-% and most preferred from about 70 wt.-% to about 75 wt.-% of diethylene glycol monobutyl ether; wherein the weight.-% of the components are based on the total weight of the cleaning composition.

According to one embodiment, the cleaning compositions, preferably in form of a concentrate, may comprise: from about 50 wt.-% to about 90 wt.-%, preferably from about 60 wt.-% to about 85 wt.-%, more preferred from about 65 wt.-% to about 80 wt.-% and most preferred from about 70 wt.-% to about 75 wt.-% of diethylene glycol monobutyl ether; from about 0.5 wt.-% to about 3 wt.-%, further preferred from about 0.75 wt.-% to about 2.5 wt.-% more preferred from about 1 wt.-% to about 2 wt.-% and most preferred from about 1.6 wt.-% to about 1.8 wt.-% of at least one $C_2$ to $C_8$ organic acid, most preferred citric acid; wherein the weight.-% of the components are based on the total weight of the cleaning composition.

According to one embodiment, the cleaning compositions, preferably in form of a concentrate, may comprise: from about 50 wt.-% to about 90 wt.-%, preferably from about 60 wt.-% to about 85 wt.-%, more preferred from about 65 wt.-% to about 80 wt.-% and most preferred from about 70 wt.-% to about 75 wt.-% of diethylene glycol monobutyl ether; from about 0.5 wt.-% to about 3 wt.-%, further preferred from about 0.75 wt.-% to about 2.5 wt.-% more preferred from about 1 wt.-% to about 2 wt.-% and most preferred from about 1.6 wt.-% to about 1.8 wt.-% of at least one $C_2$ to $C_8$ organic acid, most preferred citric acid; from about 0.35 wt.-% to about 3.5 wt.-%, more preferred from about 0.7 wt.-% to about 2.8 wt.-% and most preferred from about 1.4 wt.-% to about 2 wt.-% of at least one nonionic surfactant, preferably a $C_8$-$C_{18}$ fatty alcohol alkoxylates $C_2$-$C_6$ alkylether having 3 to 15 ethylene oxide (EO) or propylene oxide units, preferably 5 to 10 EO or propylene oxide units, more preferred a $C_{12}$-$C_{14}$ fatty alcohol ethoxylate $C_4$-alkylether having 10 EO units and most preferred a lauryl fatty alcohol ethoxybutyl ether having about 10 EO units; wherein the weight.-% of the components are based on the total weight of the cleaning composition.

According to one embodiment, the cleaning compositions, preferably in form of a concentrate, may comprise:

about 50 wt.-% to about 90 wt.-%, preferably about 60 wt.-% to about 85 wt.-%, more preferred about 65 wt.-% to about 80 wt.-% and most preferred about 70 wt.-% to about 75 wt.-% of diethylene glycol monobutyl ether;

about 0.5 wt.-% to about 3 wt.-%, further preferred about 0.75 wt.-% to about 2.5 wt.-% more preferred about 1 wt.-% to about 2 wt.-% and most preferred about 1.6 wt.-% to about 1.8 wt.-% of at least one $C_2$ to $C_8$ organic acid, more preferred citric acid;

about 0.35 wt.-% to about 3.5 wt.-%, more preferred about 0.7 wt.-% to about 2.8 wt.-% and most preferred about 1.4 wt.-% to about 2 wt.-% of at least one nonionic surfactant, preferably a $C_8$-$C_{18}$ fatty alcohol alkoxylates $C_2$-$C_6$ alkylether having 3 to 15 EO and/or propylene oxide units, preferably 5 to 10 EO and/or propylene oxide units, more preferred a $C_{12}$-$C_{14}$ fatty alcohol ethoxylate $C_4$-alkylether having 10 EO units and most preferred a lauryl fatty alcohol ethoxy-butyl ether having about 10 EO units;

about 0.05 wt.-% to about 1 wt.-%, more preferred about 0.1 wt.-% to about 0.6 wt.-% and most preferred about 0.2 wt.-% to about 0.5 wt.-% of at least one sequestering agent, more preferred tetrasodium N,N-bis(carboxylatomethyl)-L-glutamate (GLDA); wherein the weight.-% of the components are based on the total weight of the cleaning composition.

According to one embodiment, the cleaning compositions, preferably in form of a concentrate, may comprise:

about 50 wt.-% to about 90 wt.-%, preferably about 60 wt.-% to about 85 wt.-%, more preferred about 65 wt.-% to about 80 wt.-% and most preferred about 70 wt.-% to about 75 wt.-% of diethylene glycol monobutyl ether;

about 0.5 wt.-% to about 3 wt.-%, further preferred about 0.75 wt.-% to about 2.5 wt.-% more preferred about 1 wt.-% to about 2 wt.-% and most preferred about 1.6 wt.-% to about 1.8 wt.-% of at least one $C_2$ to $C_8$ organic acid, more preferred citric acid;

about 0.35 wt.-% to about 3.5 wt.-%, more preferred about 0.7 wt.-% to about 2.8 wt.-% and most preferred about 1.4 wt.-% to about 2 wt.-% of at least one nonionic surfactant, preferably a $C_8$-$C_{18}$ fatty alcohol alkoxylates $C_2$-$C_6$ alkylether having 3 to 15 EO and/or propylene oxide units, preferably 5 to 10 EO and/or propylene oxide units, more preferred a $C_{12}$-$C_{14}$ fatty alcohol ethoxylate $C_4$-alkylether having 10 EO units and most preferred a lauryl fatty alcohol ethoxybutyl ether having about 10 EO units;

about 0.1 wt.-% to about 2.5 wt.-%, more preferred about 0.5 wt.-% to about 2 wt.-%, and most preferred of about 1 wt.-% to about 1.5 wt.-% of at least one corrosion inhibitor, preferably benzotriazole, even more preferred Polygon PCG 1419 and/or Polygon PCG 1831 and most preferred at least one methyl dihydrogen phosphate and/or methyl-1H-benzotriazole; wherein the weight.-% of the components are based on the total weight of the cleaning composition.

According to one embodiment, the cleaning compositions, preferably in form of a concentrate, may comprise:

about 50 wt.-% to about 90 wt.-%, preferably about 60 wt.-% to about 85 wt.-%, more preferred about 65 wt.-% to about 80 wt.-% and most preferred about 70 wt.-% to about 75 wt.-% of diethylene glycol monobutyl ether;

about 0 wt.-% to about 5 wt.-%, preferably about 0.5 wt.-% to about 3 wt.-%, further preferred about 0.75 wt.-% to about 2.5 wt.-% more preferred about 1 wt.-% to about 2 wt.-% and most preferred about 1.6 wt.-% to about 1.8 wt.-% of at least one $C_2$ to $C_8$ organic acid, more preferred citric acid;

about 0 wt.-% to about 5 wt.-%, preferably about 0.35 wt.-% to about 3.5 wt.-%, more preferred about 0.7 wt.-% to about 2.8 wt.-% and most preferred about 1.4 wt.-% to about 2 wt.-% of at least one nonionic surfactant, preferably a $C_8$-$C_{18}$ fatty alcohol alkoxylates $C_2$-$C_6$ alkylether having 3 to 15 EO and/or propylene oxide units, preferably 5 to 10 EO and/or propylene oxide units, more preferred a $C_{12}$-$C_{14}$ fatty alcohol ethoxylate $C_4$-alkylether having 10 EO units and most preferred a lauryl fatty alcohol ethoxy butylether having about 10 EO units;

about 0 wt.-% to about 5 wt.-%, preferably about 0.05 wt.-% to about 1 wt.-%, more preferred about 0.1 wt.-% to about 0.6 wt.-% and most preferred about 0.2 wt.-% to about 0.5 wt.-% of at least one sequestering agent, more preferred tetrasodium N,N-bis(carboxylatomethyl)-L-glutamate (GLDA);

about 0 wt.-% to about 3 wt.-%, preferably about 0.1 wt.-% to about 2.5 wt.-%, more preferred about 0.5 wt.-% to about 2 wt.-%, and most preferred of about 1 wt.-% to about 1.5 wt.-% of at least one corrosion inhibitor, preferably benzotriazole, even more preferred Polygon PCG 1419 and/or Polygon PCG 1831 and most preferred at least one methyl dihydrogen phosphate and/or methyl-1H-benzotriazole;

water is added to 100 wt.-%; wherein the weight.-% of the components are based on the total weight of the cleaning composition, and the weight.-% of all components of the cleaning composition are select so that it does not exceed 100 wt.-%.

Ready-to-Use Composition

The cleaning composition can be present in form of a diluted or so called "ready-to-use" composition. The diluted compositions may be derived from concentrates, for example, by combining deionized water, city or tap water, and a concentrate or concentrates. The so called ready-to-use compositions may be treated to reduce hardness.

The source of acidity and addition of the solvent, preferably water, are provided so that the diluted, preferably aqueous, liquid composition of the cleaning composition may have a pH in the range of about 4.5 pH to about 6.0 pH or about 5 pH to about 5.5 pH.

According to one embodiment, the concentrated cleaning composition can be diluted with a solvent, preferably water, to an about 1.0 wt.-% to about 10 wt.-%, preferably to an about 2.0 wt.-% to 5.5 wt.-%, diluted cleaning composition, also named "ready-to-use solution".

As a solvent, preferably water is added to 100 wt.-% to the cleaning composition, wherein the weight.-% of the components are based on the total weight of the cleaning composition, and the weight.-% of all components of the cleaning composition are select so that it does not exceed 100 wt.-%.

It will be appreciated that the actual concentration of components in a composition of the invention will depend on the intended use of that composition.

According to one embodiment, the cleaning composition can be diluted with at least one solvent, preferably water, by a factor of 10 to 1000, preferably 20 to 500, further preferred 30 to 200 and more preferred 40 to 150 and most preferred 50 to 100 to obtain the diluted cleaning composition.

The diluted cleaning compositions may comprise about 1 wt.-% to about 2 wt.-%, preferably about 1.2 wt.-% to about 1.8 wt.-%, more preferred about 1.3 wt.-% to about 1.6 wt.-% and most preferred about 1.4 wt.-% to about 1.5 wt.-% of diethylene glycol monobutyl ether; wherein the weight.-% of the components are based on the total weight of the cleaning composition.

According to one embodiment, the diluted compositions may comprise:

about 1 wt.-% to about 2 wt.-%, preferably about 1.2 wt.-% to about 1.8 wt.-%, more preferred about 1.3 wt.-% to about 1.6 wt.-% and most preferred about 1.4 wt.-% to about 1.5 wt.-% of diethylene glycol monobutyl ether;

about 0.01 wt.-% to about 0.06 wt.-%, further preferred about 0.015 wt.-% to about 0.05 wt.-% more preferred about 0.02 wt.-% to about 0.04 wt.-% and most preferred about 0.03 wt.-% to about 0.04 wt.-% of at least one $C_2$ to $C_8$ organic acid, more preferred citric acid; wherein the weight.-% of the components are based on the total weight of the cleaning composition.

According to another embodiment, the diluted composition may comprises:

about 1 wt.-% to about 2 wt.-%, preferably about 1.2 wt.-% to about 1.8 wt.-%, more preferred about 1.3 wt.-% to about 1.6 wt.-% and most preferred about 1.4 wt.-% to about 1.5 wt.-% of diethylene glycol monobutyl ether;

about 0.01 wt.-% to about 0.06 wt.-%, further preferred about 0.015 wt.-% to about 0.05 wt.-% more preferred about 0.02 wt.-% to about 0.04 wt.-% and most preferred about 0.03 wt.-% to about 0.04 wt.-% of at least one $C_2$ to $C_8$ organic acid, more preferred citric acid;

about 0.007 wt.-% to about 0.07 wt.-%, more preferred about 0.014 wt.-% to about 0.06 wt.-% and most preferred about 0.028 wt.-% to about 0.04 wt.-% of at least one nonionic surfactant, preferably a $C_8$-$C_{18}$ fatty alcohol alkoxylates $C_2$-$C_6$ alkylether having 3 to 15 ethylene oxide (EO) and/or propylene oxide units, preferably 5 to 10 EO and/or propylene oxide units, more preferred a $C_{12}$-$C_{14}$ fatty alcohol ethoxylate $C_4$-alkylether having 10 EO units and most preferred a lauryl fatty alcohol ethoxy-butylether having about 10 EO units; wherein the weight.-% of the components are based on the total weight of the cleaning composition.

According to another embodiment, the diluted compositions may comprise:

about 1 wt.-% to about 2 wt.-%, preferably about 1.2 wt.-% to about 1.8 wt.-%, more preferred about 1.3 wt.-% to about 1.6 wt.-% and most preferred about 1.4 wt.-% to about 1.5 wt.-% of diethylene glycol monobutyl ether;

about 0.01 wt.-% to about 0.06 wt.-%, further preferred about 0.015 wt.-% to about 0.05 wt.-% more preferred about 0.02 wt.-% to about 0.04 wt.-% and most preferred about 0.03 wt.-% to about 0.04 wt.-% of at least one $C_2$ to $C_8$ organic acid, more preferred citric acid;

about 0.007 wt.-% to about 0.07 wt.-%, more preferred about 0.014 wt.-% to about 0.06 wt.-% and most preferred about 0.028 wt.-% to about 0.04 wt.-% of at least one nonionic surfactant, preferably a $C_8$-$C_{18}$ fatty alcohol alkoxylates $C_2$-$C_6$ alkylether having 3 to 15 EO and/or propylene oxide units, preferably 5 to 10 EO and/or propylene oxide units, more preferred a $C_{12}$-$C_{14}$ fatty alcohol ethoxylate $C_4$-alkylether having 10 EO units and most preferred a lauryl fatty alcohol ethoxy buthylether having about 10 EO units;

about 0.001 wt.-% to about 0.02 wt.-%, more preferred about 0.002 wt.-% to about 0.012 wt.-% and most preferred about 0.004 wt.-% to about 0.01 wt.-% of at least one sequestering agent, more preferred tetrasodium N,N-bis(carboxylatomethyl)-L-glutamate (GLDA); wherein the weight.-% of the components are based on the total weight of the cleaning composition.

According to another embodiment, the diluted compositions may comprise:

about 1 wt.-% to about 2 wt.-%, preferably about 1.2 wt.-% to about 1.8 wt.-%, more preferred about 1.3 wt.-% to about 1.6 wt.-% and most preferred about 1.4 wt.-% to about 1.5 wt.-% of diethylene glycol monobutyl ether;

about 0.01 wt.-% to about 0.06 wt.-%, further preferred about 0.015 wt.-% to about 0.05 wt.-% more preferred about 0.02 wt.-% to about 0.04 wt.-% and most preferred about 0.03 wt.-% to about 0.04 wt.-% of at least one $C_2$ to $C_8$ organic acid, more preferred citric acid;

about 0.007 wt.-% to about 0.07 wt.-%, more preferred about 0.014 wt.-% to about 0.06 wt.-% and most preferred about 0.028 wt.-% to about 0.04 wt.-% of at least one nonionic surfactant, preferably a $C_8$-$C_{18}$ fatty alcohol alkoxylates $C_2$-$C_6$ alkylether having 3 to 15 EO and/or propylene oxide units, preferably 5 to 10 EO and/or propylene oxide units, more preferred a $C_{12}$-$C_{14}$ fatty alcohol ethoxylate $C_4$-alkylether having 10 EO units and most preferred a lauryl fatty alcohol ethoxybutyl ether having about 10 EO units;

about 0.002 wt.-% to about 0.05 wt.-%, more preferred about 0.01 wt.-% to about 0.04 wt.-%, and most preferred of about 0.02 wt.-% to about 0.03 wt.-% of at least one corrosion inhibitor, preferably benzotriazole, even more preferred Polygon PCG 1419 and/or Polygon PCG 1831 and most preferred at least one methyl dihydrogen phosphate and/or methyl-1H-benzotriazole; wherein the weight.-% of the components are based on the total weight of the cleaning composition.

According to another embodiment, the diluted cleaning composition may comprise:

about 1 wt.-% to about 2 wt.-%, preferably about 1.2 wt.-% to about 1.8 wt.-%, more preferred about 1.3 wt.-% to about 1.6 wt.-% and most preferred about 1.4 wt.-% to about 1.5 wt.-% of diethylene glycol monobutyl ether;

about 0 wt.-% to about 0.1 wt.-%, preferably about 0.01 wt.-% to about 0.06 wt.-%, further preferred about 0.015 wt.-% to about 0.05 wt.-% more preferred about 0.02 wt.-% to about 0.04 wt.-% and most preferred about 0.03 wt.-% to about 0.04 wt.-% of at least one $C_2$ to $C_8$ organic acid, more preferred citric acid;

about 0 wt.-% to about 0.1 wt.-%, preferably about 0.007 wt.-% to about 0.07 wt.-%, more preferred about 0.014 wt.-% to about 0.06 wt.-% and most preferred about 0.028 wt.-% to about 0.04 wt.-% of at least one nonionic surfactant, preferably a $C_8$-$C_{18}$ fatty alcohol alkoxylates $C_2$-$C_6$ alkylether having 3 to 15 EO and/or propylene oxide units, preferably 5 to 10 EO and/or propylene oxide units, more preferred a $C_{12}$-$C_{14}$ fatty alcohol ethoxylate $C_4$-alkylether having 10 EO units and most preferred a lauryl fatty alcohol ethoxy buthylether having about 10 EO units;

about 0 wt.-% to about 0.1 wt.-%, preferably about 0.001 wt.-% to about 0.02 wt.-%, more preferred about 0.002 wt.-% to about 0.012 wt.-% and most preferred about 0.004 wt.-% to about 0.01 wt.-% of at least one sequestering agent, more preferred tetrasodium N,N-bis(carboxylatomethyl)-L-glutamate (GLDA);

about 0 wt.-% to about 0.06 wt.-%, preferably about 0.002 wt.-% to about 0.05 wt.-%, more preferred about 0.01 wt.-% to about 0.04 wt.-%, and most preferred of about 0.02 wt.-% to about 0.03 wt.-% of at least one corrosion inhibitor, preferably benzotriazole, even more preferred Polygon PCG 1419 and/or Polygon PCG 1831 and most preferred at least one methyl dihydrogen phosphate and/or methyl-1H-benzotriazole;

water is added to 100 wt.-%; wherein the weight.-% of the components are based on the total weight of the cleaning composition, and the weight.-% of all components of the cleaning composition are select so that it does not exceed 100 wt.-%.

Use of the Disinfectant Composition

The cleaning composition can be used for removal of acrylic-based polymer or polymeric materials from surfaces, such as hard surfaces and/or soft surfaces, preferably acrylic based polymeric coating materials, such as acrylic-based polymeric tablet coatings, from vessels and other equipment employed in using such materials. Various acrylic-based polymer materials are useful as delayed release coatings for medications, such as enteric delayed release, and coatings for materials, such as food, for human and animal consumption. In making such coated products, the process equipment used often becomes heavily coated with such polymeric materials. As part of the routine cleaning operation, the piece of equipment in question is taken out of service and processed to remove the acrylic-based polymeric material located on the surfaces, for example, the inside or interior surfaces, of the equipment.

The advantage of the cleaning composition is that due to the increased cleaning activity surfaces of the equipment needed to be cleaned can be for example stay in place without the need of dissembling.

The method for removing an acrylic-based polymeric material from a surface comprising in general the steps of a) contacting said acrylic-based polymeric material located on said surface to be cleaned with a cleaning composition and b) removing said acrylic-based polymeric material with the cleaning composition from said surface.

The acrylic-based polymer, also named polymeric materials, which are removable with the cleaning composition, may be chosen from a wide variety of such materials.

Particularly applicable acrylic-based polymeric materials are those which are useful in delayed release coatings, such as enteric delayed release coatings, for medications. Such materials are preferably anionic in character.

One very useful class of acrylic-based materials are polymers derived from one or more monomers selected from acrylic acid, acrylic acid esters, methacrylic acid, and/or methacrylic acid esters, preferably methacrylic acid and/or methacrylic acid esters; as well as and mixtures thereof.

Among the methacrylic acid esters which can be employed as monomers, methacrylic acid methyl ester provides acrylic-based polymeric materials which are very effectively removed with the cleaning composition. The acrylic-based polymeric materials may be insoluble in buffered aqueous solutions at a pH of about 5 or lower. The acrylic-based polymeric material may include a plasticizer component in an amount effective to increase the elasticity of the medication coatings made from such materials. Examples of useful plasticizer components include polyethylene glycols, dibutyl phthalate, glycerol triacetate, castor oil, 1,2-propylene glycol, citric acid esters, such as triethyl citrate and mixtures thereof.

The acrylic-based polymer includes poly(meth)acrylates for pharmaceutical applications. Such poly(meth)acrylates are for example known worldwide in the industry under the trade name Eudragit® available from Evonik Industries. Under Eudragit® a number of poly(meth)acrylates are available such as the group of Eudragit® L and Eudragit® R, for example Eudragit® RS 30 D having about 5% hydrophilic groups and Eudragit® RL 30 D having about 10% hydrophilic groups.

In one general embodiment, methods for removing such acrylic-based polymeric materials located on a surface comprise contacting this material with a cleaning composition, preferably a diluted cleaning composition.

The cleaning composition is used in an amount effective to reduce the adhesion between the acrylic-based polymeric material and the surface on which the material is located and to facilitate solubilizing the acrylic-based polymeric material. Each of the components of the present compositions is preferably soluble in the cleaning composition.

The present cleaning compositions may contact the acrylic-based polymeric material located on the surface of equipment at conditions effective to remove such polymeric material. Although the cleaning compositions maybe be employed at room temperature of about 23° C. to about 75° C., it is preferred to use the cleaning compositions at relatively elevated temperatures, preferably in the range of about 50° C. to about 80° C., preferably in the range of about 60° C. to about 75° C., and most preferred at 75° C., during such contacting. In order to obtain such elevated temperatures it is desirable to pass the composition through a heat exchanger prior to introducing the composition into the equipment to be cleaned.

The contacting times vary greatly depending, for example, on the specific composition and contacting conditions being employed and on the specific removal application involved. Preferably, such contacting occurs for a time in the range of about 30 seconds to about 2 hours or about 1 minute to about 1 hours, preferably 10 minutes to 30 minutes. In addition, the cleaning composition can be used on a once-thru basis, that is the composition is passed into the equipment to be cleaned only one time, or can be recirculated or recycled back through the equipment to be cleaned.

In a particularly useful embodiment, the cleaning composition is employed on a "once-thru" basis for a first period of time, preferably for about 1 minute to about 30 or further preferred about 5 minutes 20 minutes, or in addition preferred about 10 minutes to about 15 minutes.

According to one embodiment, thereafter the cleaning composition may be used by being recirculated through the equipment to be cleaned for a second period of time, preferably for about 30 seconds to about 2 hours or about 1 minute to about 1 hour, preferably 10 minutes to 30 minutes or more. During the first period of time relatively large particles of the acrylic-based polymeric material may be removed from the equipment surface or surfaces to be cleaned with a cleaning composition. In order to avoid handling problems, redeposition problems and other complications, these relatively large particles, together with the composition in which the particles are present, may be removed from the process. After this first period of time, much, if not all, of the acrylic-based polymeric material removed is solubilized in the cleaning composition. In order to take advantage of the solubility of the acrylic-based polymeric material in the cleaning composition, and preferably to maintain the cleaning composition at a relatively elevated temperature, during a second period of time the acrylic-based polymeric material-containing composition can be recirculated or recycled back to (reintroduced into) the equipment being cleaned, preferably through a heat exchanger, until the desired level of acrylic-based polymeric material removal has been obtained.

After a sufficient removal has been achieved, the cleaned piece of equipment may be preferably rinsed with water, more preferably with deionized water, in preparation for activating the equipment back into service.

The following non-limiting examples illustrate certain advantages of the present invention.

EXAMPLES

Examples E1 to E3 and C1 to C3

The compositions of examples E1 to E3 of the invention and comparative examples C1 to C3 were prepared by mixing the components as mentioned in table I below.

TABLE I

| Wt.-% *1 | C1 | E1 | C2 | E2 | C3 | E3 |
|---|---|---|---|---|---|---|
| Water*2 | 90 | 90 | 73 | 73 | 97.3 | 97.3 |
| Triethylene glycol monoethyl ether | 5 | — | 27 | — | 2.7 | — |
| Diethylene glycol monobuty ether | — | 5 | — | 27 | — | 2.7 |
| Citric Acid*3 | 5 | 5 | — | — | — | — |

*1 = wherein the weight.-% of the components are based on the total weight of the cleaning composition;
*2 = deionized water;
*3 = anhydrous citric acid Six steel plates of mild steel of 100 mm×50 mm×1.0 mm were wetted with 2 ml of an aqueous suspension containing 30 wt.-% Eudragit® RS 30D*, which is an anionic polymer synthesized from methacrylic acid and methacrylic acid methyl ester having 5% hydrophilic groups. The 2 ml of aqueous suspension containing Eudragit® RS 30D test solution* is placed on 7 mm×50 mm on the lower part of the upper outer surface area of the plate, whereby the upper part 3 mm×50 mm of the upper outer surface area of the plate is kept free of the aqueous suspension test solution. This was followed by drying at about 23° C. for about 15 hours.

*The aqueous Eudragit RS 30 D test solution is prepared by addition of 30% of active substance and 20% of plastiziser triethylcitrate.

Eudragit® RS 30D polymer is sold by Rohm Pharma (produced by Evonik Industries) under the trademark Eudragit® RS 30D, and is used as an enteric film coating in the pharmaceutical industry. Eudragit® RS 30D having about 5% hydrophilic groups was used instead of Eudragit L having about 10% hydrophilic groups, because Eudragit® RS 30D is less soluble and more difficult to remove due to the less hydrophilic character.

Mild steel is a carbon steel typically with a maximum of about 0.25 wt.-% Carbon and about 0.4 wt.-% to about 0.7 wt.-% manganese, about 0.1 wt.-% to about 0.5 wt.-% Silicon and some traces of other elements such as phosphorous.

The six coated mild steel plate were immersed separated from each other upright in a beaker containing 900 ml of a with deionized water to a 2 wt.-% diluted cleaning composition of E1 to E3 as well as C1 to C3 as mentioned in table I above, respectively. The beakers are placed in a water bath that was brought to a temperature of about 78° C. The steel plates were immersed such that the Euragit® RS 30D coated area is completely dipped upright into the cleaning composition. The temperature of the cleaning composition was adjusted before placing the plates into the cleaning composition to about 75° C. and kept at that temperature. The plates are removed from the cleaning composition for C1 after 20 minutes, for E1 after 12 minutes, for C2 after 20 minutes, for E2 after 5 minutes, for C3 after 20 minutes and E3 after 10 minutes. Then the plates are rinsed 5 times with tape water of water hardness 16° dH, measured as mg/L as CaCO3, and then 5 times rinsed with deionized water. Thereafter the plates are dried at about 23° C. for about 15 hours. Then the plates were inspected to determine how much, if any, of the coating had been removed from the six plates.

The test evaluation was visually and the results of these tests were as follows:

E1—the mild steel plate was clean after 12 minutes/about 95% removal of the coating.

E2—the mild steel plate was clean after 5 minutes/about 99% removal of the coating.

E3—the mild steel plate was clean after 10 minutes/about 90% removal of the coating.

C1—the mild steel plate was not clean after 20 minutes/about 80% removal of the coating.

C2—the mild steel plate was not clean after 20 minutes/about 10% removal of the coating.

C3—the mild steel plate was not clean after 20 minutes/about 70% removal of the coating.

The results demonstrate that the use of diethylene glycol monobuty ether has compared to triethylene glycol monoethyl ether an improved cleaning effect for removing acrylic-based polymeric material.

Examples E4 and C4 to C8

The compositions of examples E4 of the invention and comparative examples C4 to C8 were prepared by mixing the components as mentioned in table II below.

TABLE II

| Wt-% *1 | E4 | C4 | C5 | C6 | C7 | C8 |
|---|---|---|---|---|---|---|
| Water*2 | add. 100 wt.-% | add. 100 wt.-% | add. 100 wt.-% | add. 100 wt.-% | add. 100 wt.-% | add. 100 wt.-% |
| diethylene glycol monobutyl ether | 60 | — | — | — | — | — |
| diethylene glycol monoethyl ether | — | 60 | — | — | — | — |
| dipropylene glycol monobutyl ether | — | — | 60 | | — | — |
| ethylene glycol monobuthyl ether | — | — | — | 60 | — | — |
| 1,2 propylene glycol | — | — | — | — | 60 | — |
| hexylene glycol | — | — | — | — | — | 60 |
| citric acid*3 | 1.6 | 1.6 | 1.6 | 1.6 | 1.6 | 1.6 |
| nonionic surfactant *4 | 1.4 | 1.4 | 1.4 | 1.4 | 1.4 | 1.4 |
| sequestering agent*5 | 0.3 | 0.3 | 0.3 | 0.3 | 0.3 | 0.3 |
| corrosion inhibitor*6 | 1 | 1 | 1 | 1 | 1 | 1 |

*1 = wherein the weight.-% of the components are based on the total weight of the cleaning composition;
*2 = deionized water;
*3 = anhydrous citric acid;
*4 = lauryl fatty alcohol ethoxy buthylether having about 10 EO units;
*5 = terasodium N,N-bis(carboxylatomethyl)-L-glutamate (GLDA);
*6 = Polygon PCG 1419 containing methyl dihydrogen phosphate 15-25%, neutralized and Polygon PCG 1831 containing methyl-1H-Benzotriazol about 2% or less.

Six steel plates of mild steel of 100 mm×50 mm×1.0 mm were wetted with 2 ml of an aqueous suspension containing an Eudragit® RS 30D test solution*. The 2 ml of aqueous suspension containing the Eudragit® RS 30D test solution* are placed on 7 mm×50 mm on the lower part of the upper outer surface area of the six plates each, whereby the upper part 3 mm×50 mm of the upper outer surface area of the plates are kept free of the aqueous suspension containing the test solution*. This was followed by drying at about 23° C. for about 15 hours. Thereafter the six coated mild steel plates were placed each in a beaker that contains 900 ml of a with deionized water to a 2 wt.-% diluted cleaning composition of E4 and C4 to C8, as mentioned in table II above, respectively. The six beakers were placed before in a water bath that was brought to a temperature of about 78° C. The temperature of the cleaning compositions E4 and C4 to C8 were adjusted before placing the plates into the six beaker of the cleaning composition to a temperature of about 75° C. and kept at that temperature. The six steel plates were immersed separate each in one of the six beakers so that the Euragit® RS 30D coated area is completely dipped upright into the cleaning compositions E4 and C4 to C8. The six plates kept into the cleaning composition of E4 and C4 to C8 for 20 minutes at about 75° C. Thereafter, the six coated mild steel plates were removed from the cleaning composition. Then the six plates are rinsed 5 times with tape water having a water hardness of 16° dH, measured as mg/L as CaCO3, and then rinsed 5 times with deionized water each. Thereafter the six plates are dried at about 23° C. for about 15 hours and then inspected to determine how much, if any, of the coating had been removed from the six test plates.

*The aqueous Eudragit RS 30 D test solution is prepared by addition of 30% of active substance and 20% of plastiziser triethylcitrate.

The test evaluation was visually and the results of these tests were as follows:

E4—the mild steel plate was clean after 20 minutes/about >80% removal of the coating.

C4—the mild steel plate was not clean after 20 minutes/about 65% removal of the coating.

C5—the mild steel plate was not clean after 20 minutes/about 75% removal of the coating.

C6—the mild steel plate was not clean after 20 minutes/about 10% removal of the coating.

C7—the mild steel plate was not clean after 20 minutes/about 65% removal of the coating.

C8—the mild steel plate was not clean after 20 minutes/about 75% removal of the coating.

The results demonstrate that the use of diethylene glycol monobuty ether of example E4 is superior with respect to the cleaning performance compared to C4 to C8 for removing acrylic-based polymeric material.

Examples E5 and C9 to C13

The compositions of examples E5 of the invention and comparative examples C9 to C13 were prepared by mixing the components as mentioned in table III below.

TABLE III

| Wt-% *1 | E5 | C9 | C10 | C11 | C12 | C13 |
|---|---|---|---|---|---|---|
| Water*2 | add. 100 wt.-% | add. 100 wt.-% | add. 100 wt.-% | add. 100 wt.-% | add. 100 wt.-% | add. 100 wt.-% |
| diethylene glycol monobutyl ether | 70 | — | — | — | — | — |
| diethylene glycol monoethyl ether | — | 70 | — | — | — | — |
| dipropylene glycol monobutyl ether | — | — | 70 | | — | — |
| ethylene glycol monobuthyl ether | — | — | — | 70 | — | — |
| 1,2 propylene glycol | — | — | — | — | 70 | — |
| hexylene glycol | — | — | — | — | — | 70 |
| citric acid*3 | 1.6 | 1.6 | 1.6 | 1.6 | 1.6 | 1.6 |
| nonionic surfactant *4 | 1.4 | 1.4 | 1.4 | 1.4 | 1.4 | 1.4 |
| sequestering agent*5 | 0.3 | 0.3 | 0.3 | 0.3 | 0.3 | 0.3 |
| corrosion inhibitor*6 | 1 | 1 | 1 | 1 | 1 | 1 |

*1 = wherein the weight.-% of the components are based on the total weight of the cleaning composition;
*2= deionized water;
*3= anhydrous citric acid;
*4 = lauryl fatty alcohol ethoxy buthylether having about 10 EO units;
*5= terasodium N,N-bis(carboxylatomethyl)-L-glutamate (GLDA);
*6= Polygon PCG 1419 containing methyl dihydrogen phosphate 15-25%, neutralized and Polygon PCG 1831 containing methyl-1H-Benzotriazol about 2% or less.

Six steel plates of mild steel of 100 mm×50 mm×1.0 mm were wetted with 2 ml of an aqueous suspension containing an Eudragit® RS 30D test solution*. The 2 ml of aqueous suspension containing the Eudragit® RS 30D test solution* are placed on 7 mm×50 mm on the lower part of the upper outer surface area of the six plates each, whereby the upper part 3 mm×50 mm of the upper outer surface area of the plates are kept free of the aqueous suspension containing the test solution*. This was followed by drying at about 23° C. for about 15 hours. Thereafter the six coated mild steel plates were placed each in a beaker that contains 900 ml of a with deionized water to a 2 wt.-% diluted cleaning composition of E5 and C9 to C13, as mentioned in table III above, respectively. The six beakers were placed before in a water bath that was brought to a temperature of about 78° C. The temperature of the cleaning compositions E5 and C9 to C13 were adjusted before placing the plates into the six beaker of the cleaning composition to a temperature of about 75° C. and kept at that temperature. The six steel plates were immersed separate each in one of the six beakers so that the Euragit® RS 30D coated area is completely dipped upright into the cleaning compositions E5 and C9 to C13. The six plates kept into the cleaning composition of E5 and C9 to C13 for 20 minutes at about 75° C. Thereafter, the six coated mild steel plates were removed from the cleaning composition. Then the six plates are rinsed 5 times with tape water having a water hardness of 16° dH, measured as mg/L as CaCO3, and then rinsed 5 times with deionized water each. Thereafter the six plates are dried at about 23° C. for about 15 hours and then inspected to determine how much, if any, of the coating had been removed from the six test plates.

*The aqueous Eudragit RS 30 D test solution is prepared by addition of 30% of active substance and 20% of plastiziser triethylcitrate.

The test evaluation was visually and the results of these tests were as follows:

E5—the mild steel plate was clean after 20 minutes/about >95% removal of the coating.

C9—the mild steel plate was not clean after 20 minutes/about 70% removal of the coating.

C10—the mild steel plate was not clean after 20 minutes/about 85% removal of the coating.

C11—the mild steel plate was not clean after 20 minutes/about 15% removal of the coating.

C12—the mild steel plate was not clean after 20 minutes/about 70% removal of the coating.

C13—the mild steel plate was not clean after 20 minutes/about 80% removal of the coating.

The results demonstrate that the use of diethylene glycol monobutyl ether of example E5 is superior with respect to the cleaning performance compared to C9 to C19 for removing acrylic-based polymeric material.

Examples E6 and C14 to C18

The compositions of examples E6 of the invention and comparative examples C14 to C18 were prepared by mixing the components as mentioned in table VI below.

TABLE IV

| Wt-% *1 | E6 | C14 | C15 | C16 | C17 | C18 |
|---|---|---|---|---|---|---|
| Water*2 | add. 100 wt.-% | add. 100 wt.-% | add. 100 wt.-% | add. 100 wt.-% | add. 100 wt.-% | add. 100 wt.-% |
| diethylene glycol monobutyl ether | 75 | — | — | — | — | — |
| diethylene glycol monoethyl ether | — | 75 | — | — | — | — |
| dipropylene glycol monobutyl ether | — | — | 75 | | — | — |
| ethylene glycol monobuthyl ether | — | — | — | 75 | — | — |
| 1,2 propylene glycol | — | — | — | — | 75 | — |
| hexylene glycol | — | — | — | — | — | 75 |
| citric acid*3 | 1.6 | 1.6 | 1.6 | 1.6 | 1.6 | 1.6 |
| nonionic surfactant *4 | 1.4 | 1.4 | 1.4 | 1.4 | 1.4 | 1.4 |
| sequestering agent*5 | 0.3 | 0.3 | 0.3 | 0.3 | 0.3 | 0.3 |
| corrosion inhibitor*6 | 1 | 1 | 1 | 1 | 1 | 1 |

*1 = wherein the weight.-% of the components are based on the total weight of the cleaning composition;
*2= deionized water;
*3= anhydrous citric acid;
*4 = lauryl fatty alcohol ethoxy buthylether having about 10 EO units;
*5= terasodium N,N-bis(carboxylatomethyl)-L-glutamate (GLDA);
*6= Polygon PCG 1419 containing methyl dihydrogen phosphate 15-25%, neutralized and Polygon PCG 1831 containing methyl-1H-Benzotriazol about 2% or less.

Six steel plates of mild steel of 100 mm×50 mm×1.0 mm were wetted with 2 ml of an aqueous suspension containing an Eudragit® RS 30D test solution*. The 2 ml of aqueous suspension containing the Eudragit® RS 30D test solution* are placed on 7 mm×50 mm on the lower part of the upper outer surface area of the six plates each, whereby the upper part 3 mm×50 mm of the upper outer surface area of the plates are kept free of the aqueous suspension containing the test solution*. This was followed by drying at about 23° C.

for about 15 hours. Thereafter the six coated mild steel plates were placed each in a beaker that contains 900 ml of a with deionized water to a 2 wt.-% diluted cleaning composition of E6 and C14 to C18, as mentioned in table IV above, respectively. The six beakers were placed before in a water bath that was brought to a temperature of about 78° C. The temperature of the cleaning compositions E6 and C14 to C18 were adjusted before placing the plates into the six beaker of the cleaning composition to a temperature of about 75° C. and kept at that temperature. The six steel plates were immersed separate each in one of the six beakers so that the Euragit® RS 30D coated area is completely dipped upright into the cleaning compositions E6 and C14 to C18. The six plates kept into the cleaning composition of E6 and C14 to C18 for about 20 minutes at about 75° C. Thereafter, the six coated mild steel plates were removed from the cleaning composition. Then the six plates are rinsed 5 times with tape water having a water hardness of 16° dH, measured as mg/L as CaCO3, and then rinsed 5 times with deionized water each. Thereafter the six plates are dried at about 23° C. for about 15 hours and then inspected to determine how much, if any, of the coating had been removed from the six test plates.

*The aqueous Eudragit RS 30 D test solution is prepared by addition of 30% of active substance and 20% of plastiziser triethylcitrate.

The test evaluation was visually and the results of these tests were as follows:

E6—the mild steel plate was clean after 20 minutes/about 100% removal of the coating.

C14—the mild steel plate was not clean after 20 minutes/about 75% removal of the coating.

C15—the mild steel plate was not clean after 20 minutes/about 90% removal of the coating.

C16—the mild steel plate was not clean after 20 minutes/about 10% removal of the coating.

C17—the mild steel plate was not clean after 20 minutes/about 75% removal of the coating.

C18—the mild steel plate was not clean after 20 minutes/about 85% removal of the coating.

The results demonstrate that the use of diethylene glycol monobutyl ether of example E6 is superior with respect to the cleaning performance compared to C14 to C18 for removing acrylic-based polymeric material.

Material Compatibility Test

This test method provides a basis to assess the enhanced corrosion inhibition of the cleaning composition E7, E8 and E9 compared with C19.

The compositions of examples E7, E8 and E9 of the invention and comparative example C19 were prepared by mixing the components as mentioned in table V below.

TABLE V

| wt-% *1 | E7 | E8 | E9 | C19 |
|---|---|---|---|---|
| Water*2 | add. 100 wt.-% | add. 100 wt.-% | add. 100 wt.-% | add. 100 wt.-% |
| diethylene glycol monobutyl ether | 75 | 75 | 75 | — |
| ethylene glycol monobuthyl ether | — | — | — | 80 |
| citric acid*3 | 1.6 | 1.6 | 0.9 | 12 |
| nonionic surfactant *4 | 1.4 | 1.4 | 1.4 | 1.5 |
| sequestering agent*5 | 0.3 | 0.3 | 0.3 | — |
| corrosion inhibitor*6 | 1 | — | 1 | — |

*1 = wherein the weight.-% of the components are based on the total weight of the cleaning composition;
*2= deionized water;
*3= anhydrous citric acid;
*4 = lauryl fatty alcohol ethoxy buthylether having about 10 EO units;
*5= terasodium N,N-bis(carboxylatomethyl)-L-glutamate (GLDA);
*6= Polygon PCG 1419 containing methyl dihydrogen phosphate 15-25%, neutralized and Polygon PCG 1831 containing methyl-1H-Benzotriazol about 2% or less.

Corrosion Testing Equipment 350 ml wide-necked screw cap flasks for each test condition Acetone Aluminum test plates of 100 mm×50 mm×1.0 mm Mild steel test plates of 100 mm×50 mm×1.0 mm Copper test plates of 100 mm×50 mm×1.0 mm Brass test plates of 100 mm×50 mm×1.0 mm (The aluminum, mild steel, copper and brass test plates are cleaned with acetone before use)

Clean paper toweling

Stop watch

Drying oven

Analytical balance capable of weighing to the 0.0001 place.

Test Method

The cleaning compositions E7, E8, E9 and C19 were diluted with deionized water to a 2 wt.-% cleaning solution. The weights of aluminum, mild steel, copper and brass test plates of 100 mm×50 mm×1.0 mm were recorded and then placed in the center area of the bottom of a 350 ml wide-necked screw cap flask each. The aluminum, mild steel, copper and brass test plates were completely submerged. Subsequently, each wide-necked screw cap flask was filed to the top with said 2 wt.-% cleaning solution E7, E8, E9 and C19 having a temperature of about 23° C. The wide-necked screw cap flasks were closed with the cap and allow staying for 7 days at a temperature of about 23° C. Thereafter, the aluminum, mild steel, copper and brass test plates were removed, rinsed with deionized water, placed on a clean paper towel and allowed to dry at a temperature of about 23° C. The aluminum, mild steel, copper and brass test plates were then weighted and the weight was taken to the fourth place. Subsequently the aluminum, mild steel, copper and brass test plates were returned in the fresh 2 wt.-% cleaning solution in there wide-necked screw cap flasks for another 7 days. Thereafter, the aluminum, mild steel, copper and brass test plates were removed, rinsed with deionized water, placed on a clean paper towel and allowed to dry at a temperature of about 23° C. The weight loss was calculated. Three tests were run for each experiment and the average weight loss was determined.

Results of these tests weight changes in % were as follows:

Mild Steel

E7—average weight loss about 0.0071;

E8—average weight loss about 0.1194;

E9—average weight loss about 0.1805;

C19—average weight loss about 1.2205;

Aluminum

E7—average weight loss about 0.0945;

E8—average weight loss about 0.1296;

E9—average weight loss about 0.1115;

C19—average weight loss about 0.4805;

Cooper
E7—average weight loss about 0.0398;
E8—average weight loss about 0.0063;
E9—average weight loss about 0.0769;
C19—average weight loss about 0.0705;
Brass
E7—average weight loss about 0.0620;
E8—average weight loss about 0.0052;
E9—average weight loss about 0.0293;
C19—average weight loss about 0.1594.

The results demonstrate surprisingly that the use of 1.6 wt.-% citric acid of E7 has an improved corrosion inhibition effect compared with E9 having 0.9 wt.-% citric acid only. Further, the comparison example C19 shows a significant worse corrosion inhibition effect compared with E7, E8 and E9.

Example E8 differs from E7 and E9 in that it is free of a corrosion inhibitor. With the exception of aluminum, for other metals E8 shows a better corrosion inhibition than E9, although E8 has a double citric acid concentration compared with E9 having in addition an corrosion inhibitor. It is somewhat surprising that the increase of citric acid in a defined range provides a remarkable corrosion inhibition effect.

All publications and patent applications in this specification are indicative of the level of ordinary skill in the art to which this invention pertains. The invention has been described to various specific and preferred embodiments and techniques. However, it should be understood that many variations and modifications may be made while remaining within the spirit and scope of the invention.

What is claimed is:

1. A method for removing an acrylic-based polymeric material from a pharmaceutical equipment surface comprising:

(a) diluting a concentrate composition with water to form a diluted composition, the concentrate composition comprising:
- about 50 wt.-% to about 90 wt.-% diethylene glycol monobutyl ether;
- about 0.5 wt.-% to about 3 wt.-% of at least one $C_2$ to $C_{10}$ organic acid; and
- water, (b) contacting the pharmaceutical equipment surface with the diluted composition for 30 seconds to 2 hours at a temperature of about 23° C. to about 80° C. as part of a clean-in-place process, the diluted composition having a pH from about 4.5 to about 6.0 and (c) removing the acrylic-based polymeric material with the diluted composition from the pharmaceutical equipment surface.

2. The method according to claim 1, wherein the acrylic-based polymeric material is selected from the group consisting of: acrylic acid, acrylic acid esters, methacrylic acid, methacrylic acid esters and mixtures thereof.

3. The method according to claim 1, wherein the diluted composition is employed at a temperature in the range of about 50° C. to about 75° C.

4. The method according to claim 1, wherein the diluted composition is employed at a temperature about 75° C.

5. The method according to claim 1, wherein the diluted composition is employed of about 1 minute to about 1 hour.

6. The method according to claim 1, wherein the diluted composition is employed for 20 minutes.

7. The method of claim 1 wherein the concentrate composition further comprises:

at least one nonionic surfactant wherein the nonionic surfactant is a $C_8$-$C_{18}$ fatty alcohol alkoxylate $C_2$-$C_6$ alkylether having 3 to 15 ethylene oxide and/or propylene oxide units.

8. The method of claim 1 wherein the $C_2$-$C_{10}$ organic acid is selected from the group consisting of: acetic acid, propionic acid, iso-propionic acid, butanoic acid, pentanoic acid, hexanoic acid, heptanoic acid, octanoic acid, nonanoic acid, decanoic acid, glycolic acid, citric acid, lactic acid, tartaric acid, fumaric acid, malic acid, itaconic acid, ascorbic acid, benzoic acid, salicylic acid, succinic acid and mixtures thereof.

9. The method of claim 1 wherein the $C_2$-$C_{10}$ organic acid is citric acid.

10. The method of claim 1, wherein the concentrate composition further comprises:

at least one nonionic surfactant; and optionally a sequestering agent or corrosion inhibitor.

11. The method of claim 1, wherein the cleaning composition has a flash point above 70° C.

12. The method of claim 1, wherein the cleaning composition is free of anionic surfactants, monoalcohols, silicates, and additional glycol ethers.

13. The method of claim 1, wherein the diethylene glycol monobutyl ether and organic acid are present in a ratio of 150:1 to 30:1.

14. The method of claim 7 wherein the concentrate composition further comprises:

a sequestering agent selected from the group consisting of: sodium gluconate, diethylenetriamine pentaacetic acid (DTPA), sodium glucoheptonate, ethylene diamine tetraacetic acid (EDTA), hydroxyethyl ethylene diamine triacetic acid, nitrilotriacetic acid (NTA), diethanolglycine sodium salt, ethanoldiglycine disodium salt, hydroxymonocarboxylic acid compounds, hydroxydicarboxylic acid compounds, tetrasodium N,N-bis(carboxylato-methyl)-L-glutamate (GLDA), hydroxyethylethylene-diaminetriacetate (HEDTA), methyl-glycinediacetate (MGDA), and mixtures thereof.

15. The method of claim 7 wherein the concentrate composition further comprises:

a corrosion inhibitor selected from the group consisting of: silicate, sodium silicate, sodium disilicate, calcium acetate, calcium chloride, calcium gluconate, calcium phosphate, calcium borate, calcium carbonate, calcium citrate, calcium lactate, calcium sulfate, calcium tartrate, benzotriazole, 1,2,3-benzotriazole, and mixtures thereof.

16. A method for removing an acrylic-based polymeric material from a pharmaceutical equipment surface comprising:

(a) contacting the acrylic-based polymeric material located on the pharmaceutical equipment surface with a cleaning composition for 30 seconds to 2 hours at a temperature of about 23° C. to about 80° C. as part of a clean-in-place process, the cleaning composition comprising:
- about 50 wt.-% to about 90 wt.-% diethylene glycol monobutyl ether;
- about 0.5 wt.-% to about 5 wt.-%, of at least one $C_2$ to $C_8$ organic acid;
- about 0 wt.-% to about 5 wt.-% of at least one nonionic surfactant;
- about 0 wt.-% to about 5 wt.-%, of at least one sequestering agent;

about 0 wt.-% to about 3 wt.-% of at least one corrosion inhibitor; and water added to 100 wt.-%; and (b) removing acrylic-based polymeric material with the cleaning composition from the pharmaceutical equipment surface.

17. The method of claim 16 wherein the cleaning composition further comprises a weight-% ratio of diethylene glycol monobutyl ether to $C_2$ to $C_{10}$ organic acid from about 150:1 to about 30:1, based on the total weight of the cleaning composition.

18. The method of claim 16 wherein the cleaning composition further comprises a weight-% ratio of diethylene glycol monobutyl ether to $C_2$ to $C_{10}$ organic acid from about 85:1 to about 80:1, based on the total weight of the cleaning composition.

19. The method of claim 16 wherein the cleaning composition is employed at a temperature in the range of about 23° C. to about 75° C.

20. The method of claim 16 wherein the cleaning compositions is employed of about 10 minutes to about 30 minutes.

21. The method of claim 16, wherein the cleaning composition has a flash point above 70° C.

22. The method of claim 16, wherein the cleaning composition is free of a monoalcohol selected from the group consisting of ethanol, isopropanol, 2-butoxy ethanol, 1-decanol, benzyl alcohol, and combinations thereof.

23. The method of claim 16, wherein the pH of the composition is from about 4.5 to about 6.0.

24. The method of claim 20 wherein the cleaning compositions is employed of about 10 minutes to about 30 minutes.

25. A method for removing an acrylic-based polymeric material from a pharmaceutical equipment surface comprising:

(a) contacting the acrylic-based polymeric material located on the pharmaceutical equipment surface with a cleaning composition for 30 seconds to 2 hours at a temperature of about 23° C. to about 80° C. as part of a clean-in-place process, the cleaning composition comprising:

about 1 wt.-% to about 2 wt.-% diethylene glycol monobutyl ether;

about 0.01 wt.-% to about 0.1 wt.-%, of at least one $C_2$ to $C_8$ organic acid;

about 0 wt.-% to about 0.1 wt.-% of at least one nonionic surfactant;

about 0 wt.-% to about 0.1 wt.-%, of at least one sequestering agent;

about 0 wt.-% to about 0.06 wt.-% of at least one corrosion inhibitor; and water added to 100 wt.-%; and (b) removing acrylic-based polymeric material with the cleaning composition from the pharmaceutical equipment surface.

26. The method of claim 25 wherein the cleaning composition is employed at a temperature in the range of about 23° C. to about 75° C.

27. The method of claim 25, wherein the cleaning composition has a flash point above 70° C.

28. The method of claim 25, wherein the cleaning composition is free of a monoalcohol selected from the group consisting of ethanol, isopropanol, 2-butoxy ethanol, 1-decanol, benzyl alcohol, and combinations thereof.

29. The method of claim 25, wherein the pH of the composition is from about 4.5 to about 6.0.

* * * * *